US008145111B2

(12) United States Patent
Bae

(10) Patent No.: US 8,145,111 B2
(45) Date of Patent: Mar. 27, 2012

(54) FUSING DEVICE AND IMAGE FORMING APPARATUS HAVING THE SAME

(75) Inventor: Sea-chul Bae, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 706 days.

(21) Appl. No.: 12/207,613

(22) Filed: Sep. 10, 2008

(65) Prior Publication Data

US 2009/0097891 A1 Apr. 16, 2009

(30) Foreign Application Priority Data

Oct. 16, 2007 (KR) ..... 10-2007-0104248

(51) Int. Cl.
*G03G 15/20* (2006.01)

(52) U.S. Cl. ..... 399/329; 399/333

(58) Field of Classification Search ..... 399/329–331, 399/333

See application file for complete search history.

(56) References Cited

U.S. PATENT DOCUMENTS 6,748,192 B2 * 6/2004 Izawa et al. ..... 399/329
7,376,379 B2 * 5/2008 Takahashi et al. ..... 399/329

FOREIGN PATENT DOCUMENTS

KR 2003-0037143 5/2003
KR 10-2006-0110098 10/2006

OTHER PUBLICATIONS

Korean Office Action for corresponding Korean Patent Application No. 10-2007-0104248 dated Dec. 30, 2011.

* cited by examiner

*Primary Examiner* — Hoang Ngo
(74) *Attorney, Agent, or Firm* — Staas & Halsey LLP

(57) ABSTRACT

A fusing device is provided for use in an image forming apparatus to fuse a toner image having a polarity on a printable medium. Such a fusing device comprises: a heating roller which comprises a heat source; a driving roller which is spaced apart from the heating roller; a fusing belt which travels on the heating roller and the driving roller and is heated by the heating roller; a pressing roller which forms a fusing nip against a surface of the fusing belt and presses the printable medium to the fusing belt; and a power supply which applies a voltage to the pressing roller to electrify the printable medium into a polarity opposite to the polarity of the toner image.

19 Claims, 6 Drawing Sheets

FIG. 6

| Bias (b) | 10^8 Ω / ▭ | 10^6 Ω / ▭ (a) |
|---|---|---|
| 250V | STRONG | MEDIUM |
| 350V | MEDIUM | WEEK |
| 450V | WEEK | WEEK |
| 550V | WEEK | NO OCCURRENCE |
| 650V | NO OCCURRENCE | NO OCCURRENCE |

FUSING DEVICE AND IMAGE FORMING APPARATUS HAVING THE SAME

CROSS-REFERENCE TO RELATED APPLICATION

This application claims all benefits accruing under 35 U.S.C. §119 from Korean Patent Application No. 2007-104248, filed on Oct. 16, 2007 in the Korean Intellectual Property Office, the disclosure of which is incorporated herein by reference.

BACKGROUND OF THE INVENTION

1. Field of the Invention

The present invention relates to a fusing device which fuses a toner image on a printable medium and an image forming apparatus having the same, and more particularly, to a fusing device which electrifies a printable medium to enhance fusing efficiency to a toner image and an image forming apparatus having the same.

2. Description of the Related Art

In general, an image forming apparatus of an electro-photographic type forms an electrostatic latent image on an image support, such as, a photosensitive body, electrified at a predetermined electric potential through exposure, develops such a latent image with toner, and transfers and fuses a toner image onto a printable medium to form an image.

A fusing device is typically provided in a printing path of such an image forming apparatus, to fuse a toner image on the printable medium under heat and pressure, i.e., toner is melted and bonded to the printable medium by heat and pressure rollers.

FIG. 1 illustrates a fusing device 10 of a typical image forming apparatus. Referring to FIG. 1, the fusing device 10 includes a fusing roller 20 in which a heat source (not shown) is provided, and a pressing roller 30 which is disposed opposite to the fusing roller 20 and is elastically pressed toward the fusing roller 20 by an elastic member 31 to fuse a toner image on a printable medium.

Generally, a surface of the fusing roller 20 is heated by heat from the heat source 21. When a printable medium M on which a toner image T is transported to the fusing device 10, the printable medium M passes a fusing nip N1 which is formed between the fusing roller 20 and the driving roller 30. Here, the toner image T is fused onto the printable medium M by heat and pressure, thereby completing a fusing process.

Recently, as a printing speed of an image forming apparatus increases, and time when the printable medium passes through the fusing device decreases, fusing efficiency can also be decreased. In particular, if charge per mass of toner is low, an adhesive force to the printable medium becomes weak. Moreover, if moisture in the printable medium is evaporated, a toner which is adhered to the printable medium is removed to the outside, thereby causing a so-called line burst phenomenon. In this case, the toner is removed here and there on the printable medium, thereby causing an inconvenience to a user.

SUMMARY OF THE INVENTION

Several aspects and example embodiments of the present invention provide a fusing device which electrifies a printable medium into a polarity opposite to the polarity of a toner image so as to increase an adhesive force between the toner image and the printable medium and minimize the line burst phenomenon, and an image forming apparatus having the same.

Additional aspects and/or advantages of the present invention will be set forth in part in the description which follows and, in part, will be obvious from the description, or may be learned by practice of the present invention.

In accordance with an example embodiment of the present invention, a fusing device is provided to fuse a toner image having a polarity on a printable medium. Such a fusing device comprises: a heating roller which comprises a heat source; a driving roller which is spaced apart from the heating roller; a fusing belt which travels on the heating roller and the driving roller and is heated by the heating roller; a pressing roller which forms a fusing nip against a surface of the fusing belt and presses the printable medium to the fusing belt; and a power supply which applies a voltage to the pressing roller to electrify the printable medium into a polarity opposite to the polarity of the toner image during the fusing operation.

According to an aspect of the present invention, the fusing belt may include: a cover layer which contacts the pressing roller; a base layer which contacts the heating roller and the driving roller; and an intermediate layer which is provided between the cover layer and the base layer, wherein the cover layer and the intermediate layer comprise a non-conductive material and the base layer comprises a conductive material.

According to an aspect of the present invention, a surface of the driving roller may include a conductive material, and the driving roller may be grounded at a side thereof. The heating roller may be grounded at a side thereof.

According to an aspect of the present invention, a resistance per area of the base layer may be larger than 10^5Ω and smaller than 10^8Ω. The voltage applied from the power supply may be larger than 200V and smaller than 800V.

In accordance with another example embodiment of the present invention, a fusing device is provided to fuse a toner image having a polarity on a printable medium, including: a heating roller which comprises a heat source and is grounded at a side thereof; a driving roller which is spaced apart from the heating roller and has a conductive surface; a non-conductive fusing belt which travels on the heating roller and the driving roller and is heated by the heating roller; a pressing roller which forms a fusing nip against a surface of the fusing belt and presses the printable medium to the fusing belt; and a power supply which applies a voltage to the pressing roller to electrify the printable medium into a polarity opposite to the polarity of the toner image.

In accordance with yet another example embodiment of the present invention, an image forming apparatus comprises: a printable medium supplying part which supplies a printable medium; an image forming part which forms a toner image on the printable medium; a fusing device which electrifies the printable medium into a polarity opposite to the polarity of the toner image and applies heat and pressure to the printable medium to fuse the toner image; and a discharging part which discharges the printable medium passed through the fusing device.

According to an aspect of the present invention, the fusing device may include: a heating roller which comprises a heat source and is grounded at a side thereof; a driving roller which is spaced from the heating roller; a conductive fusing belt which travels on the heating roller and the driving roller and is heated by the heating roller; a pressing roller which forms a fusing nip against a surface of the fusing belt and presses the printable medium to the fusing belt; and a power supply which applies a voltage to the pressing roller to electrify the printable medium into a polarity opposite to the polarity of the toner image during the fusing operation.

According to another aspect of the present invention, the fusing device may alternatively include: a heating roller which comprises a heat source and is grounded at a side thereof; a driving roller which is spaced from the heating roller, has a conductive surface and is grounded at a side thereof; a fusing belt which travels on the heating roller and the driving roller and is heated by the heating roller; a pressing roller which forms a fusing nip against a surface of the fusing belt and presses the printable medium to the fusing belt; and a power supply which applies a voltage to the pressing roller to electrify the printable medium into a polarity opposite to the polarity of the toner image during the fusing operation.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

FIG. 6 is a table showing experimental results of the line burst phenomenon of the fusing device according to an example embodiment of the present invention.

DETAILED DESCRIPTION OF THE EMBODIMENTS

Figure 1:
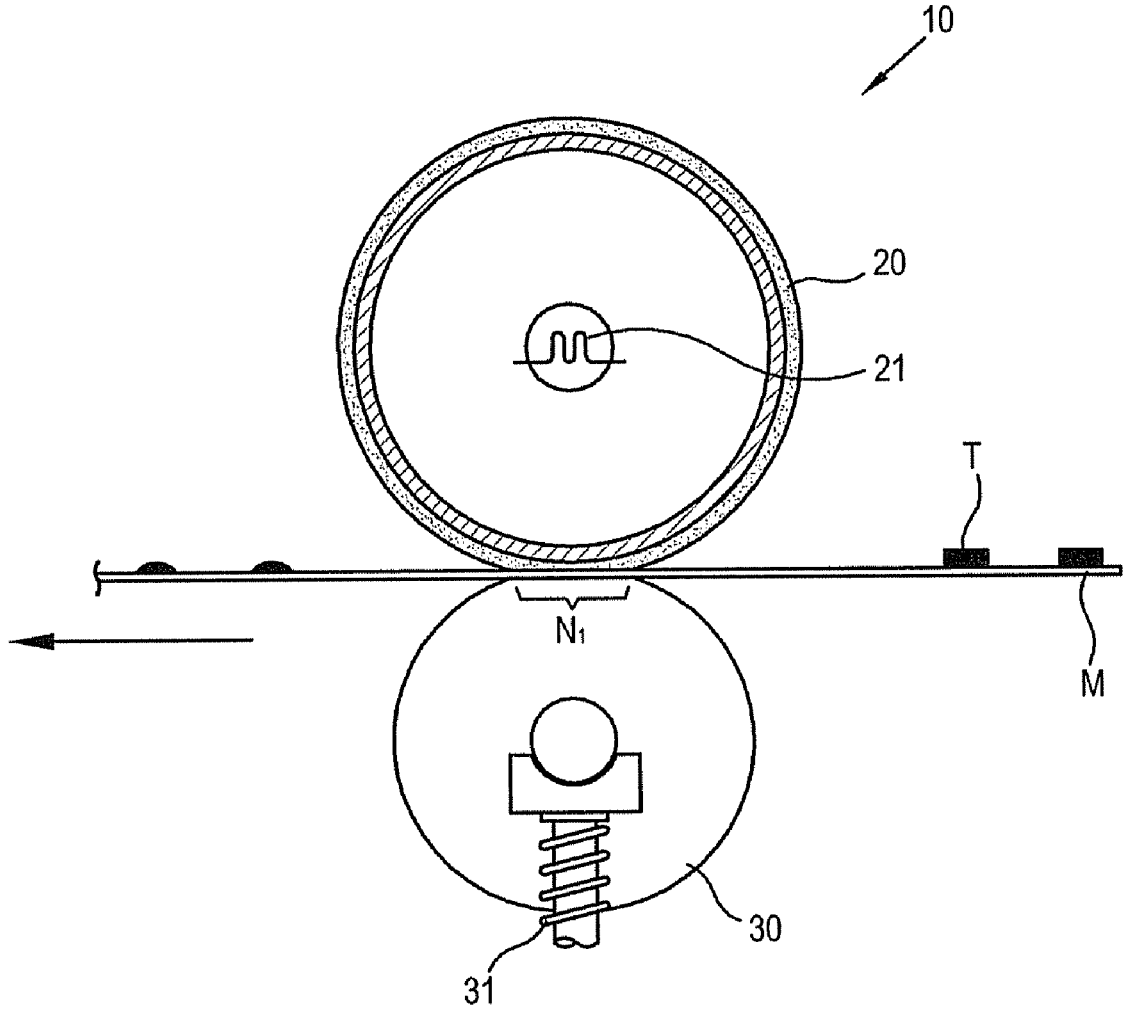
FIG. 1 illustrates a fusing device for use in a typical image forming apparatus.

Reference will now be made in detail to the embodiments of the present invention, examples of which are illustrated in the accompanying drawings, wherein like reference numerals refer to like elements throughout. The exemplary embodiments are described below in order to explain the present invention by referring to the figures.

Figure 2:
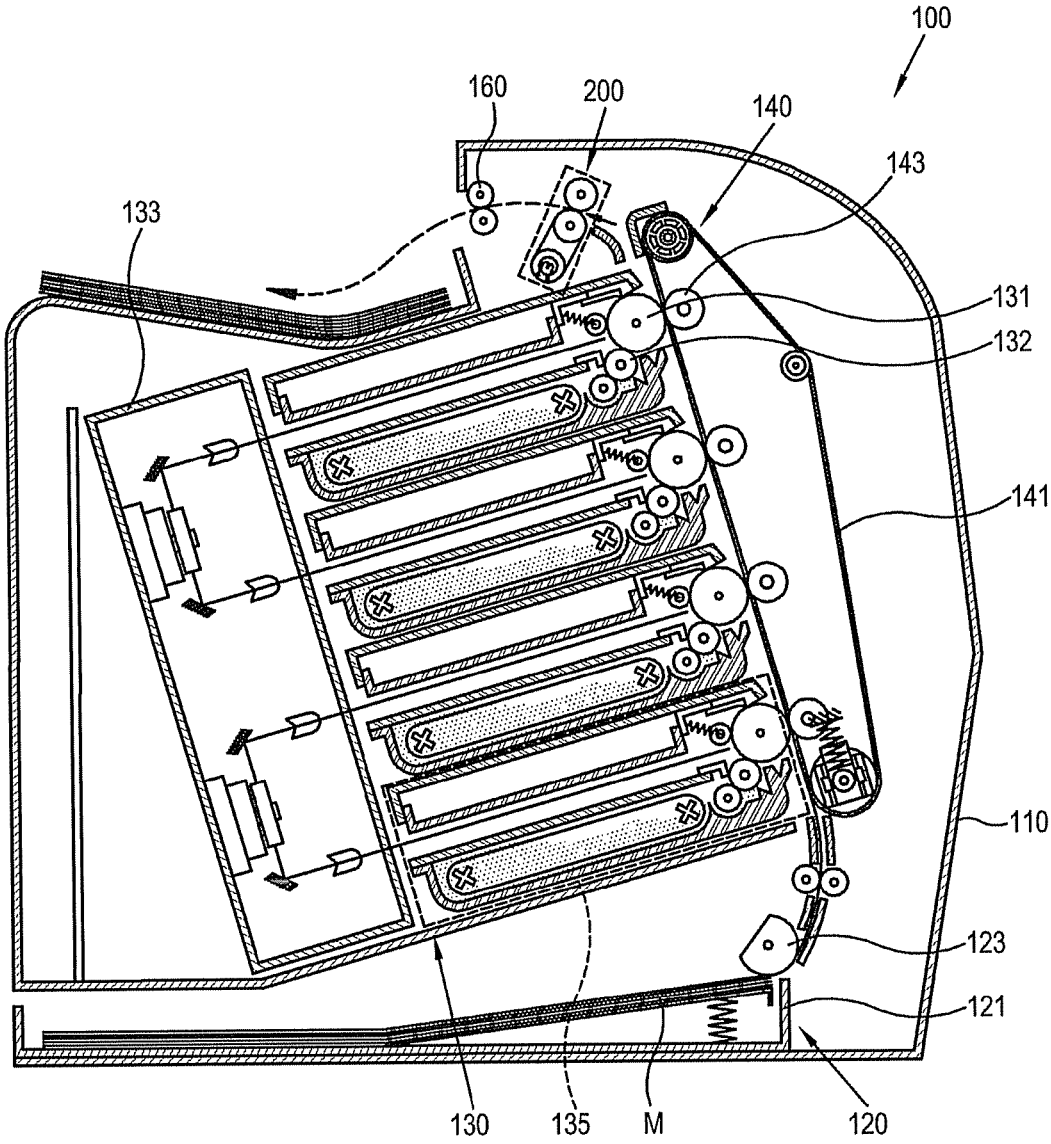
FIG. 2 illustrates an image forming apparatus according to an example embodiment of the present invention.
Figure 3:
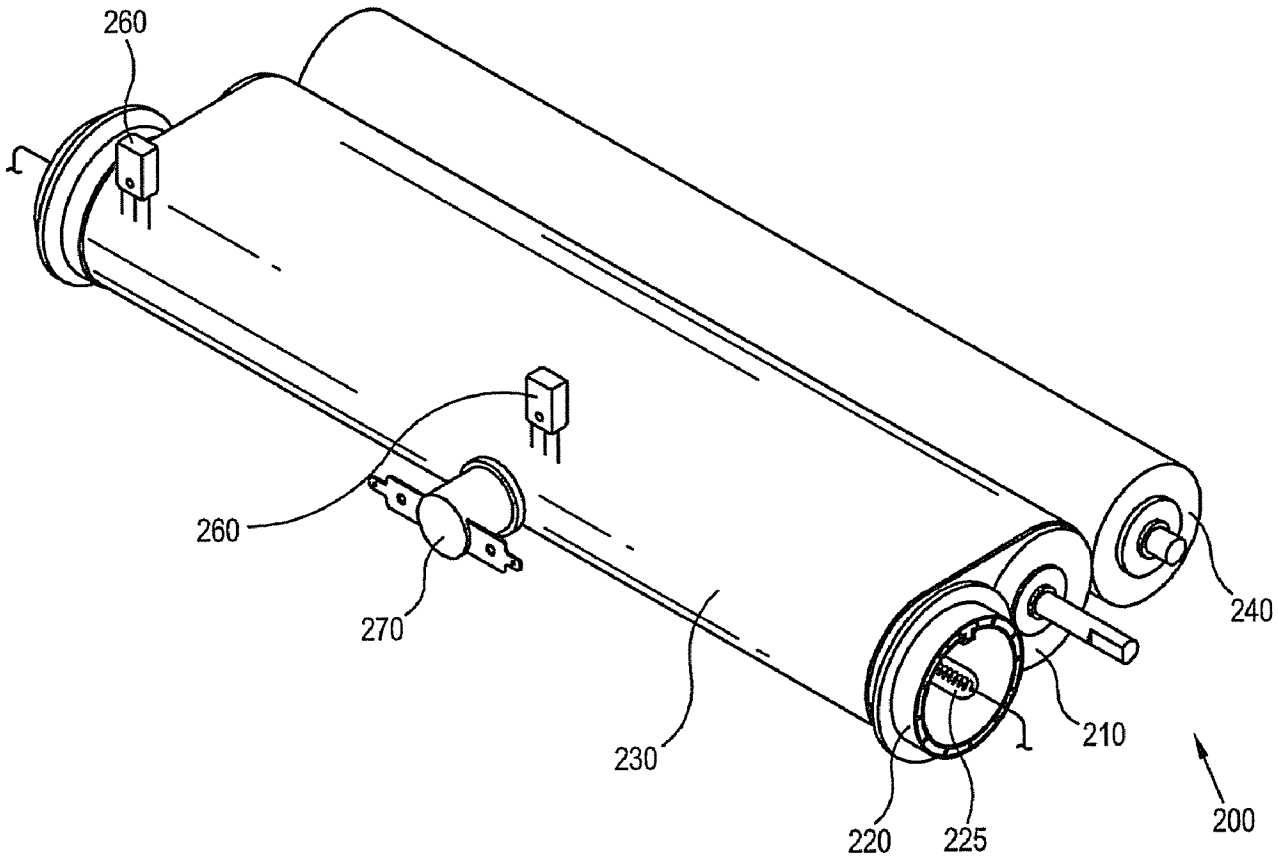
FIG. 3 is a perspective view of a fusing device for use in an image forming apparatus according to an example embodiment of the present invention.

Referring to FIGS. 2 and 3, an image forming apparatus according to an example embodiment of the present invention comprises a printable medium supplying part 120 which supplies a printable medium; a developing part 130 which forms a toner image on the printable medium; a transferring part 140 which transfers the printable medium having the toner image formed thereon by the developing part 130 along a printing path; a fusing device 200 which fuses the toner image on the printable medium; and a discharging part 160 which discharges the printable medium having an image fused thereon to the outside.

The developing part 130 includes a photosensitive body 131, a light scan unit 133 which scans light to the photosensitive body 131 to form an electrostatic latent image, and a developing unit 135 which develops a toner image from the electrostatic latent image formed on the photosensitive body 131.

Referring to FIG. 2, an image forming apparatus of a tandem type for color image is shown only by way of example. Here, the photosensitive body 131, the light scan unit 133 and the developing unit 135 are disposed along a traveling path of the printable medium for every color.

The light scan unit 133 scans light corresponding to color information onto the photosensitive body 131. The photosensitive body 131 is made by coating a light conductive material on a circumferential surface of a cylindrical drum of metal. An electrifying unit (not shown) is provided adjacent to the photosensitive body 131 to electrify an outer circumference of the photosensitive body 131 at a predetermined electric potential. The outer circumference of the photosensitive body 131 is divided into a first portion on which light from the light scan unit 131 is scanned and a second portion on which the light is not scanned. Accordingly, an electric potential difference is generated between the first and second portions of the photosensitive body 131, thereby forming an electrostatic latent image on the outer circumference of the photosensitive body 131. The electrostatic latent image has an electric potential level higher than a reference electric potential level.

The developing unit 135 includes a developing roller 132 which supplies a developer, that is, a toner to the photosensitive body 131. The developing roller 132 transfers the developer (toner) attached thereto to the photosensitive body 131. Here, the developing roller 132 for supplying the developer (toner) may include a contact type in which the developing roller 132 contacts the photosensitive body 131, and a non-contact type in which the developing roller 132 is spaced from the photosensitive body 131 by a predetermined gap. Hereinafter, the non-contact type of a developing roller 132 will be described by way of example, but not limited thereto.

The photosensitive body 131 and the developing roller 132 are rotated, being spaced apart from each other by a predetermined gap, that is, a developing gap. A developing bias voltage is then applied to the developing roller 132 to develop the electrostatic latent image formed on the photosensitive body 131. The developing bias voltage may be obtained by overlapping a predetermined alternating voltage on a reference minus (−) direct voltage, by way of example. Thus, the developer (toner) is attached to only the electrostatic latent image having an electric potential higher than the reference electric potential. The developer (toner) oscillates in a developing area inside of the developing gap to move onto the electrostatic latent image of the photosensitive body 131.

The transferring part 140 is disposed opposite to the plurality of photosensitive bodies 131 along a feeding path with the printable medium M moving along the feeding path and transfers the toner image on the photosensitive body 131 to the printable medium M.

The transferring part 140 includes a transferring belt 141 which is disposed opposite to the plurality of photosensitive bodies 131, and a transferring roller 143 to which a transfer bias voltage having a polarity opposite to the polarity of the toner image is applied to transfer the toner image on the photosensitive body 131 to the printable medium M. Here, the toner image is transferred to the printable medium M by an electrostatic force generated between the photosensitive body 131 and the transferring roller 143.

The transfer bias voltage is positive (+) if the developer (toner) is electrified into negative (−), and negative if the developer (toner) is electrified into positive (+). Hereinafter, it is assumed that the developer (toner) is electrified into negative (−) only by way of example.

The fusing device 200 according to an example embodiment of the present invention forms a fusing nip N2 by a pressing force, and heats and presses the printable medium passing through the fusing nip N2 to fuse (fix) the toner image on the printable medium.

Figure 4:
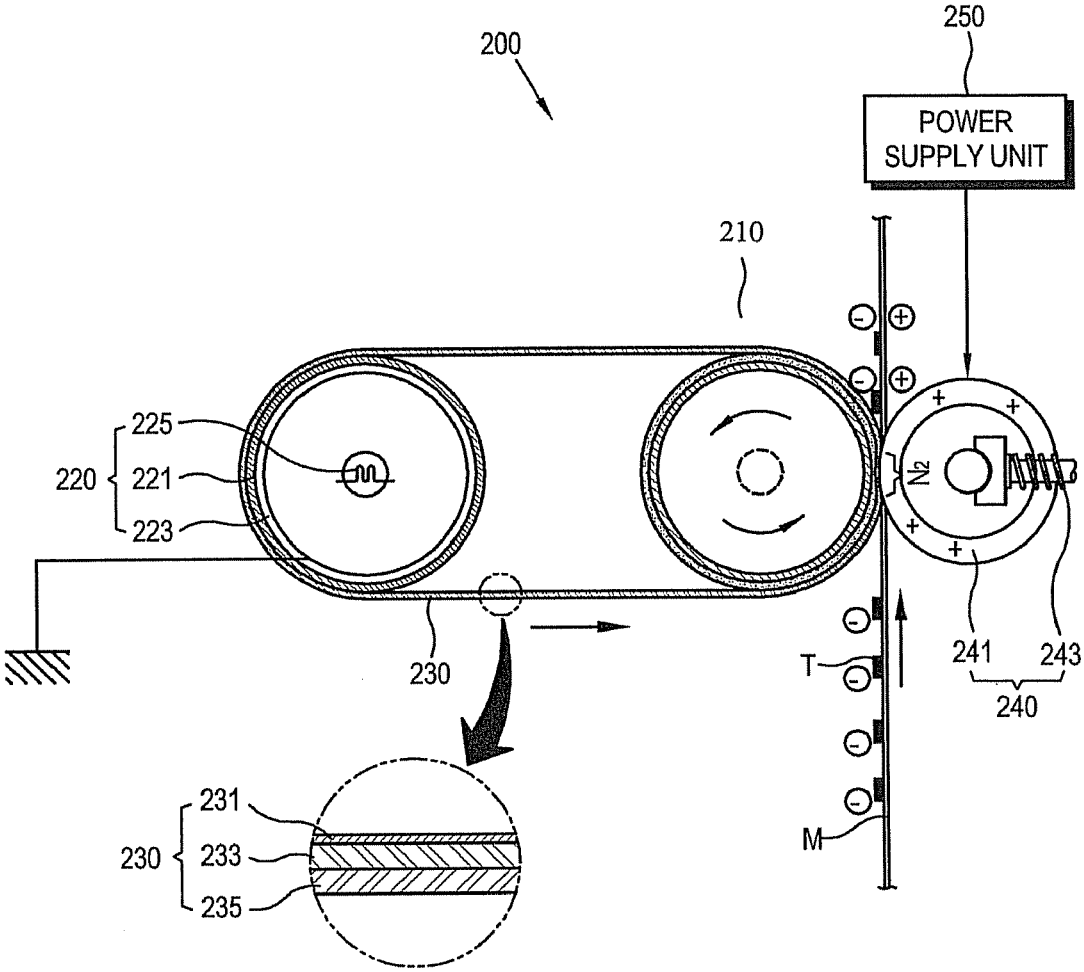
FIG. 4 is a section view of the fusing device shown in FIG. 3.

Turning now to FIG. 3 and FIG. 4, a perspective view and a section view of a fusing device for use in an image forming apparatus according to an example embodiment of the present invention are shown respectively. As shown in FIG. 3 and FIG. 4, the fusing device 200 includes a heating roller 220 which is provided with a heat source 225, a driving roller 210 which is spaced apart from the heating roller 220, a fusing belt 230 which travels on the heating roller 220 and the driving roller 210, a pressing roller 240 which presses the printable medium M toward the driving roller 210, and a power supply unit 250 which supplies power to electrify an outer circumference of the pressing roller 240 into a polarity opposite to the polarity of the toner image T formed on the printable medium.

The driving roller 210 is rotated by means of a driving source (not shown). The pressing roller 240 is elastically biased toward the driving roller 210 by an elastic member 243 and presses the printable medium M against the driving roller 210 and the fusing belt 230.

The fusing nip N2 is formed between the driving roller 210 and the pressing roller 240. The fusing belt 230 is rotated by a frictional force and a pressing force in the fusing nip N2. Here, the pressing roller 240 is rotated by a frictional force against the fusing belt 230.

In the present embodiment, the driving roller 210 is driven by the driving source (not shown). However, the heating roller 220 may alternatively be driven by the driving source.

The heating roller 220 is heated by the heat source 225 and transfers heat to the fusing belt 230 to fuse the toner image formed on the printable medium. The heating roller 220 includes an outer roller part 221 and an inner roller part 223. The outer roller part 221 may include an elastic layer made of synthetic resin, rubber or the like.

The heat source 225 may include a heating coil which is disposed between the outer roller part 221 and the inner roller part 223, and generates a Joule heat by electric resistance. Alternatively, the heat source 225 may also be a halogen lamp which is disposed inside of the inner roller part 223, and generates a convection heat. Heat generated by the heat source 225 is transferred to the fusing belt 230, via the outer roller part 221.

The fusing belt 230 may receive a driving force by the heating roller 220 or the driving roller 210. Here, the length of the fusing nip N2 may be adjusted by adjusting a contact angle of the fusing belt 230 and the pressing roller 240.

The fusing belt 230 may include a base layer 231 which contacts the heating roller 220 and driving roller 210, an intermediate layer 233 which is disposed on the base layer 231 and functions as a heat transfer layer, and a cover layer 235 which covers the intermediate layer 233 and contacts the pressing roller 240.

The pressing roller 240 is elastically biased by the elastic member 243 and presses the printable medium M against the driving roller 210 and the fusing belt 230. The outer surface of the pressing roller 240 is made of a conductive material.

The power supply unit 250 applies a voltage having a polarity opposite to the polarity of the toner image to the pressing roller 240. That is, the power supply 250 applies a positive (+) voltage if the toner image has a negative (−) polarity, and applies a negative (−) voltage if the toner image has a positive (+) polarity.

Referring to FIG. 4, in the fusing device 200 according to an example embodiment of the present invention, the fusing belt 230 includes a conductive material and the heating roller 220 is grounded, so as to allow current applied from the power supply unit 250 to flow into the fusing belt 230 through the pressing roller 240.

Here, if the whole elements of the fusing belt 230 are made of a conductive material, current may leak through a ground terminal of the heating roller 220. As a result, it is desirable that a part of the fusing belt 230 is made of a conductive material. For example, the intermediate layer 233 and the cover layer 235 may be made of a non-conductive material, and the base layer 231 may be made of a conductive material. In this case, minute current flows between the pressing roller 240 and the fusing belt 230 to form an electric field necessary for electrifying the printable medium.

For example, the intermediate layer 233 and the cover layer 235 may be made of a PFA (Per Fluoro Alkoxy) tube and silicon rubber, respectively; and the base layer 231 may be made of a conductive PI (Polyimide).

In this case, if voltage having a polarity opposite to the polarity of the toner image T is applied from the power supply unit 250, minute current flows between the pressing roller 240 and the fusing belt 230 to form an electric field. Here, according to an experiment conducted, if a positive voltage of +700V is applied from the power supply unit 250, the outer surface 241 of the pressing roller 240 is electrified into a voltage of about +700V and the outer surface of the fusing belt 230 is electrified into a voltage of about +500V. That is, the surface of the pressing roller 240 has a relatively high voltage compared with the surface of the fusing belt 230, and accordingly, the printable medium M is electrified into the high voltage of the pressing roller 240. Accordingly, the printable medium M attracts the toner image T having the opposite polarity by an electrostatic force, thereby increasing an adhesive force of the toner image T against the printable medium M.

As for the material of the fusing belt 230, any one of the intermediate layer 233 and the cover layer 235 may be made of a conductive material as necessary, instead of the base layer 231.

Figure 5:
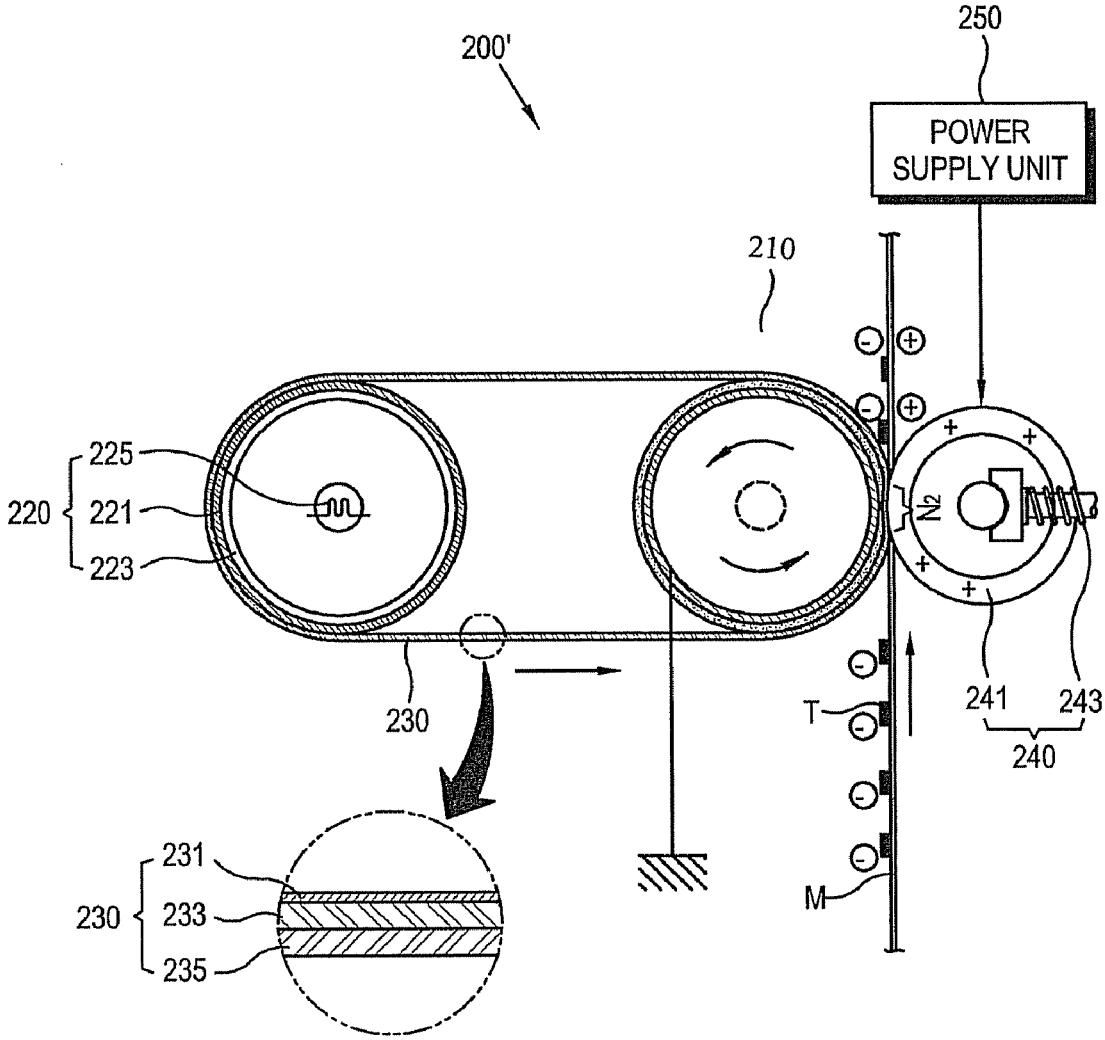
FIG. 5 is a section view of a fusing device for use in an image forming apparatus according to another example embodiment of the present invention.

FIG. 5 is a section view of a fusing device for use in an image forming apparatus according to another example embodiment of the present invention. Referring to FIG. 5, the fusing device 200' comprises similar components as shown in FIG. 4. However, a surface of a driving roller 210' is made of a conductive material, and a fusing belt 230 is made of a non-conductive material. The driving roller 210' is grounded at a side thereof. Similar to the example embodiment shown in FIG. 4, minute current flows between the fusing belt 230 and the pressing roller 240, and thus, the printable medium M is electrified into a polarity opposite to the polarity of the toner image T formed on the printable medium M.

In addition, the fusing device 200' may further include a thermistor 260 which is provided as a part of the fusing belt 230 to detect temperature of the surface of the fusing belt 230, and a thermostat 270 which cuts off power being supplied from the heat source 225 if the surface temperature of the fusing belt 230 is beyond a predetermined reference temperature.

Hereinafter, an image forming process of the image forming apparatus 100 according to an example embodiment of the present invention will be described with reference to FIGS. 2 to 4.

First, if a printing signal is applied, the printable medium supplying part 120 supplies a printable medium. The light scan unit 133 scans light to form an electrostatic latent image on a surface of the photosensitive body 131. Here, the electrostatic latent image has a relatively high voltage compared with surroundings. The developing roller 132 then applies a developing bias voltage to a developer (toner) so as to develop an electrostatic latent image on the photosensitive body 131.

The transferring roller 143 applies a voltage having a polarity opposite to the polarity of the developer (toner image), that is, a positive (+) voltage in this embodiment to the transferring belt 141 to transfer the developer (toner image) to the printable medium M. The printable medium M on which the toner image T is formed is then transported to the fusing device 200.

If the printable medium is transported to the fusing device 200, the power supply unit 250 applies a voltage having a positive (+) polarity opposite to the polarity of the toner image to the pressing roller 240. Thus, the surface of the pressing roller 240 is electrified into a positive (+) polarity. Then, the fusing belt 230 rotates opposite to the pressing roller 240 in contact with the pressing roller 240. As the base layer 231 of the fusing belt 230 is made of a conductive material, a semiconductor state is generated between the pressing roller 240 and the fusing belt 230 to form an electric field. Thus, as shown in FIG. 4, the printable medium is electrified into the same positive (+) polarity as the pressing roller 240 while passing through the fusing nip N2 between the pressing roller 240 and the fusing belt 230.

If the printable medium is electrified into a polarity opposite to the polarity of the toner image T, the printable medium attracts the toner image T on the surface thereof by an electrostatic force, thereby increasing an adhesive force of the toner image T to the printable medium M. As a result, it is possible to advantageously prevent the line burst phenomenon, that is, the toner image T comes off the printable medium M.

FIG. 6 is a table showing experimental results of the line burst phenomenon according to a voltage applied to the pressing roller 240 and a resistance of the fusing belt 230. As shown in FIG. 6, if the resistance per area of the fusing belt 230 is 10^8Ω and 10^6Ω, and as the voltage applied to the pressing roller 240 is increased, the line burst phenomenon is decreased.

However, if the resistance of the fusing belt 230 is below 10^5Ω, as a voltage of 1 kV or more is applied, current leakage is generated; and if the resistance of the fusing belt 230 is above 10^10Ω, even when a voltage of 3 kV or more is applied, the line burst phenomenon does not decrease.

As described above, according to the present invention, the fusing belt is made of a conductive material and the heating roller is grounded, and thus, the printable medium is electrified into a polarity opposite to the polarity of the toner image so as to attract the toner image to the printable medium, thereby minimizing the line burst phenomenon and increasing the printing quality.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, a fusing device may be constituted with only a fusing roller and a pressing roller, without a fusing belt, as long as an outer surface of the fusing roller is made of a conductive material and is grounded while the printable medium is electrified into a polarity opposite to the polarity of the toner image during a fusing operation. Moreover, the voltage applied to the pressing roller to electrify the printable medium into a polarity opposite to the polarity of the toner image during a fusing operation may be the same bias voltage or derived from the same bias voltage applied to the transferring roller 143 at the transferring part 140 as the printable medium is transported into the fusing device 200 for a fusing operation. Furthermore, all voltages can be supplied from a single power supply unit controlled by a single controller. Accordingly, it is intended, therefore, that the present invention not be limited to the various example embodiments disclosed, but that the present invention includes all embodiments falling within the scope of the appended claims.

What is claimed is:

1. A fusing device which fuses a toner image having a polarity on a printable medium, comprising:

a heating roller which comprises a heat source;

a driving roller which is spaced apart from the heating roller;

a fusing belt which travels on the heating roller and the driving roller and is heated by the heating roller;

a pressing roller which forms a fusing nip against a surface of the fusing belt and presses the printable medium to the fusing belt; and a power supply which applies a voltage to the pressing roller to electrify the printable medium into a polarity opposite to the polarity of the toner image, wherein the fusing nip is formed between the driving roller and the pressing roller, and wherein the fusing belt is fitted over and around the heating roller and the driving roller.

2. The fusing device according to claim 1, wherein the fusing belt comprises:

a cover layer which contacts the pressing roller;

a base layer which contacts the heating roller and the driving roller; and an intermediate layer which is provided between the cover layer and the base layer, wherein the cover layer and the intermediate layer comprise a non-conductive material and the base layer comprises a conductive material.

3. The fusing device according to claim 1, wherein a surface of the driving roller comprises a conductive material, and the driving roller is grounded at a side thereof.

4. The fusing device according to claim 2, wherein the heating roller is grounded at a side thereof.

5. The fusing device according to claim 2, wherein a resistance per area of the base layer of the fusing belt is larger than 10^5Ω and smaller than 10^8Ω.

6. The fusing device according to claim 5, wherein the voltage applied from the power supply is larger than 200V and smaller than 800V.

7. A fusing device according to claim 1, wherein the heating roller is grounded at a side thereof, wherein the driving roller has a conductive surface, and wherein the fusing belt is non-conductive.

8. An image forming apparatus, comprising:

a printable medium supplying part which supplies a printable medium;

an image forming part which forms a toner image on the printable medium;

a fusing device which electrifies the printable medium into a polarity opposite to the polarity of the toner image and applies heat and pressure to the printable medium to fuse the toner image onto the printable medium; and a discharging part which discharges the printable medium passed through the fusing device, wherein the fusing device comprises:

a heating roller which comprises a heat source and is grounded at a side thereof;

a driving roller which is spaced apart from the heating roller;

a conductive fusing belt which travels on the heating roller and the driving roller and is heated by the heating roller;

a pressing roller which forms a fusing nip against a surface of the fusing belt and presses the printable medium to the fusing belt; and a power supply which applies a voltage to the pressing roller to electrify the printable medium into a polarity opposite to the polarity of the toner image, wherein the fusing nip is formed between the driving roller and the pressing roller, and wherein the fusing belt is fitted over and around the heating roller and the driving roller.

9. An image forming apparatus, comprising:

a printable medium supplying part which supplies a printable medium;

an image forming part which forms a toner image on the printable medium;

a fusing device which electrifies the printable medium into a polarity opposite to the polarity of the toner image and applies heat and pressure to the printable medium to fuse the toner image onto the printable medium; and a discharging part which discharges the printable medium passed through the fusing device, wherein the fusing device comprising:

a heating roller which comprises a heat source and is grounded at a side thereof;

a driving roller which is spaced apart from the heating roller, has a conductive surface and is grounded at a side thereof;

a non-conductive fusing belt which travels on the heating roller and the driving roller and is heated by the heating roller;

a pressing roller which forms a fusing nip against a surface of the fusing belt and presses the printable medium to the fusing belt; and a power supply which applies a voltage to the pressing roller to electrify the printable medium into a polarity opposite to the polarity of the toner image, wherein the fusing nip is formed between the driving roller and the pressing roller, and wherein the fusing belt is fitted over and around the heating roller and the driving roller.

10. The fusing device according to claim 2, wherein the cover layer and the intermediate layer of the fusing belt are made of a PFA (Per Fluoro Alkoxy) tube and silicon rubber respectively, and the base layer of the fusing belt is made of a conductive PI (Polyimide).

11. The fusing device according to claim 7, further comprising:

a thermistor arranged to detect a surface temperature of the fusing belt; and a thermostat arranged to cut off the voltage being applied from the power supply if the surface temperature of the fusing belt exceeds a predetermined reference temperature.

12. The image forming apparatus according to claim 8, wherein the conductive fusing belt comprises:

a cover layer which contacts the pressing roller;

a base layer which contacts the heating roller and the driving roller; and an intermediate layer which is provided between the cover layer and the base layer, wherein the cover layer and the intermediate layer comprise a non-conductive material and the base layer comprises a conductive material.

13. The image forming apparatus according to claim 12, wherein a surface of the driving roller comprises a conductive material, and the driving roller is grounded at a side thereof.

14. The image forming apparatus according to claim 12, wherein the heating roller is grounded at a side thereof.

15. The image forming apparatus according to claim 12, wherein a resistance per area of the base layer of the fusing belt is larger than 10^5Ω and smaller than 10^8Ω.

16. The image forming apparatus according to claim 12, wherein the voltage applied from the power supply is larger than 200V and smaller than 800V.

17. The image forming apparatus according to claim 12, wherein the cover layer and the intermediate layer of the fusing belt are made of a PFA (Per Fluoro Alkoxy) tube and silicon rubber respectively, and the base layer of the fusing belt is made of a conductive PI (Polyimide).

18. A process of fusing a toner image onto a printable medium using a fusing device comprising a heating roller, a driving roller and a pressing roller, comprising:

arranging the heating roller and the driving roller on which a fusing belt travels, wherein the driving roller is adjacent to a pressing roller which forms a fusing nip against a surface of the fusing belt when a printable medium having a toner image formed thereon is pressed to the fusing belt; and applying a voltage to the pressing roller to electrify the printable medium into a polarity opposite to the polarity of a toner image formed on the printable medium, as the printable medium passes through the fusing nip, wherein the fusing nip is formed between the driving roller and the pressing roller, and wherein the fusing belt is fitted over and around the heating roller and the driving roller.

19. The process according to claim 18, wherein the voltage applied from a power supply is larger than 200V and smaller than 800V.

* * * * *